US006317121B1

(12) United States Patent
An

(10) Patent No.: US 6,317,121 B1
(45) Date of Patent: Nov. 13, 2001

(54) LIQUID CRYSTAL DISPLAY WITH LEVEL SHIFTING FUNCTION

(75) Inventor: Kil Bum An, Kyunggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/182,202

(22) Filed: Oct. 30, 1998

(30) Foreign Application Priority Data

Nov. 1, 1997 (KR) ..... P97-57614

(51) Int. Cl.[7] ..... G09G 5/00; G09G 3/36

(52) U.S. Cl. ..... 345/211; 345/98; 345/100; 345/204

(58) Field of Search ..... 345/98–100, 204, 345/211, 96; 326/80, 63

(56) References Cited

U.S. PATENT DOCUMENTS 4,697,930 * 10/1987 Roberts et al. ..... 368/82
5,355,383 * 10/1994 Lockard ..... 372/38
5,723,986 * 3/1998 Nakashiro et al. ..... 326/63
5,726,676 * 3/1998 Callahan, Jr. et al. ..... 345/204
5,731,796 * 3/1998 Furuhashi et al. ..... 345/96
5,764,225 * 6/1998 Koshobu ..... 345/211
5,774,106 * 6/1998 Nitta et al. ..... 345/98
5,877,737 * 3/1999 Kim et al. ..... 345/211

* cited by examiner

*Primary Examiner*—Bipin Shalwala
*Assistant Examiner*—David L Lewis
(74) *Attorney, Agent, or Firm*—Fleshner & Kim, LLP.

(57) ABSTRACT

A liquid crystal display apparatus with a level shifting function, devices or cells simplifies the circuit configuration and minimize a signal delay therein. The apparatus uses analog switches to shift each voltage level of timing control signals and data signals to be transferred from a controller to driving integrated circuits. The analog switches complementarily deliver high level voltage signals and low level voltage signals into the driving integrated circuits in response to any ones of the timing control signals and the data signals.

8 Claims, 5 Drawing Sheets

LIQUID CRYSTAL DISPLAY WITH LEVEL SHIFTING FUNCTION

BACKGROUND OF THE INVENTION

1. Field of the Invention

This invention relates to a liquid crystal display apparatus, and more particularly to a liquid crystal display apparatus which has a level shifting function or device.

2. Description of the Prior Art

Generally, a liquid crystal display apparatus displays pictures for video signals by controlling the light transmissivity of a liquid crystal. Generally, the liquid crystal display apparatus includes a liquid crystal panel arranged in a matrix type, driving integrated circuits (D-ICs) for driving the liquid crystal matrix, and a programmable logic device (PLD) for generating various control signals in the shape of pulse to control the D-ICs. The liquid crystal display apparatus further includes a level shifting device, depending upon whether either amorphous silicon thin film transistors (TFTs) or poly silicon TFTs were arranged to the liquid crystal panel to serve as a switch, for selectively switching data signals applied to liquid crystal cells. The level shifting device is needed since a driving voltage level of amorphous silicon TFTs is different from poly silicon TFTs.

As shown in FIG. 1, a liquid crystal display apparatus employing a liquid crystal panel 10, in which amorphous silicon TFTs are arranged together with liquid crystal cells, includes D-ICs 12 and a PLD 14. The PLD 14 generates timing control signals for controlling the operations of the D-ICs 12, and transfers video data from the outside thereof to the D-ICs 12 disposed on the edges of the liquid crystal panel 10. The timing control signals outputted from the PLD 14 and the video data have a swing width of 5.0 V or 3.3 V that is equal to a driving voltage of amorphous silicon TFT. The D-ICs 12 switch the amorphous silicon TFTs on the liquid crystal panel 10 and applies signal voltages corresponding the video data to the liquid crystal cells, thereby displaying a picture corresponding to the video data.

As shown in FIG. 2, a liquid crystal display apparatus employing a liquid crystal panel 20, in which poly silicon TFTs having an operating voltage level above 20 V higher than that of the amorphous silicon TFT are arranged together with liquid crystal cells, further includes a level shifting device 22 in addition to the D-ICs 12 and the PLD 14. The level shifting device 22 is connected between the PLD 14 and the D-ICs 12 to shift voltage levels of both timing control signals to be transferred from the PLD 14 to the D-ICs 12 and video data such that swing widths of the timing control signals and the video data increase from 5.0 V or 3.3 V to 20 V. Using the timing control signals and the shifted video data level, the D-ICs 12 drives the liquid crystal panel 20 comprising the poly silicon TFTs.

In order to shift the voltage levels of the timing control signals and the video data simultaneously, the level shifting apparatus comprises a number of level shifters.

Usually, amplifiers as shown in FIG. 3 are used for the number of level shifters included in the level shifting apparatus. The amplifier includes an operational amplifier 30 for receiving an input signal in a shape of pulse having a swing width V1 at the non-inverting terminal (+) thereof, a first resistor R1 connected between the inverting terminal (−) of the operational amplifier 30 and a ground GND, and a second resistor R2 connected between the inverting terminal (−) and the output terminal of the operational amplifier 30.

The amplifier 30 is driven with a high level voltage V+ and a low level voltage V− and amplifies the input signal on the non-inverting terminal (+) thereof by a voltage amplification ratio Av corresponding to a resistance ratio of the first resistors R1 to the second resistor R2 plus 1, i.e., Av=1+R1/R2. As a result, a pulse signal having a swing width corresponding to a difference between the high level voltage V+ and the low level voltage V− is outputted at the output terminal of the operational amplifier 30. If the difference voltage between the high level voltage V+ and the low level voltage V− is 20 V, then a pulse signal having a swing width of 20 V is outputted at the output terminal of the operational amplifier 30.

Alternatively, a comparator as shown in FIG. 4 may be used for the level shifters included in the level shifting apparatus. The comparator 40 has an inverting terminal (−) for receiving a reference voltage and a non-inverting terminal (+) for receiving an input signal in a shape of pulse having a swing width of V1. The reference voltage is set to have a voltage lower than the highermost voltage level and higher than the lowermost voltage level.

Accordingly, a pulse signal corresponding to a difference voltage between the high level voltage V+ and the low level voltage V− emerges at the output terminal of the comparator 40. If the voltage difference between the high level voltage V+ and the low level voltage V− is 20 V, then a pulse signal having a swing width of 20 V is outputted at the output terminal of the comparator 40.

The above amplifier and comparator have a complicate circuit configuration because they require a relatively large number of circuit devices. This results in a complication in a circuit configuration of the level shifting apparatus as well as having a difficulty in simplifying the liquid crystal display apparatus. Also, the amplifier and the comparator used for the level shifter waste a relatively large amount power and have a slow response speed.

SUMMARY OF THE INVENTION

An object of the present invention is to solve at least the problems and disadvantages of the background and prior art.

Another object of the present invention is to simplify the circuit configuration.

A further object of the present invention is to minimize a signal delay.

In order to achieve this and other objects of the invention, a liquid crystal display apparatus according to the present invention comprises a liquid crystal panel including poly silicon thin film transistors and liquid crystal cells, a plurality of driving integrated circuits for driving the liquid crystal panel, control means for generating timing control signals and data signals, each having a small swing width, required to control the plurality of driving integrated circuits, and a plurality of level shifting means for shifting each voltage level of the timing control signals and the data signal to be transferred from the control means to the driving integrated circuits, wherein each of said level shifting means includes a first voltage source for generating a high level voltage signal, a second voltage source for generating a low level voltage signals, and switching control means, being responsive to any ones of the timing control signals and the data signals, for complementarily transferring the high level voltage signal and the low level voltage signal to the driving integrated circuits.

The present invention may be achieved in a whole or in parts by a display apparatus comprising: a display panel including a plurality of pixels; a plurality of driving integrated circuits for driving the display panel; a control circuit that generates timing control signals and data signals; and a plurality of level shifting cells for shifting voltage levels of at least one of the timing control signals and the data signal to be transferred from the control circuit to the driving integrated circuits wherein each of the level shifting cells includes a first switch coupled for receiving a high level voltage signal; and a second switch coupled for receiving a low level voltage signal, said first and second switches being complementarily responsive to at least one of the timing control signals and the data signals for one of the high and low voltage signals corresponding driving integrated circuit.

The present invention may be achieved in a whole or in parts by an integrated switching device for a display panel responsive to at least one of control and data signals, comprising: a first cell having a first switch and a second switch which are responsive to at least one of control and data signals, the switch being coupled for receiving a first voltage at a first input line and providing a first output at a first output line, and the second switch being coupled for receiving a second voltage at a second input line and providing a second output at the first output line; and a second cell having a third switch and a fourth switch which are responsive to at least one of control and data signals, the third switch being coupled for receiving the first voltage at the first input line and providing a third output at a second output line, and the fourth switch being coupled for receiving the second voltage at the second input line and providing a fourth output at a second output line, wherein each of the first, second, third, and fourth switches output one of the first and second voltages as the first, second, third and fourth outputs, respectively, in response to at least one of control signals and data signals, a voltage difference between the first and second voltages being greater than a voltage difference of a corresponding control signal or a corresponding data signal.

The present invention may be achieved in a whole or in parts by A level shifting cell for a display panel responsive to at least one of control and data signals, comprising: a first switch being coupled for receiving a first voltage at a first input line and providing a first output at a first output line; and a second switch being coupled for receiving a second voltage at a second input line and providing a second output at the first output line, wherein the first second switches are responsive to at least one of control and data signals, and each of said first and second switches output one of the first and second voltages as the first and second output a voltage difference between the first and second voltages being greater than a voltage difference of a corresponding control signal or a corresponding data signal.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

These invention will be described in detail with reference to the following drawings in which like reference numerals refer to like elements wherein.

DETAILED DESCRIPTION OF THE PREFERRED EMBODIMENT

Figure 5:
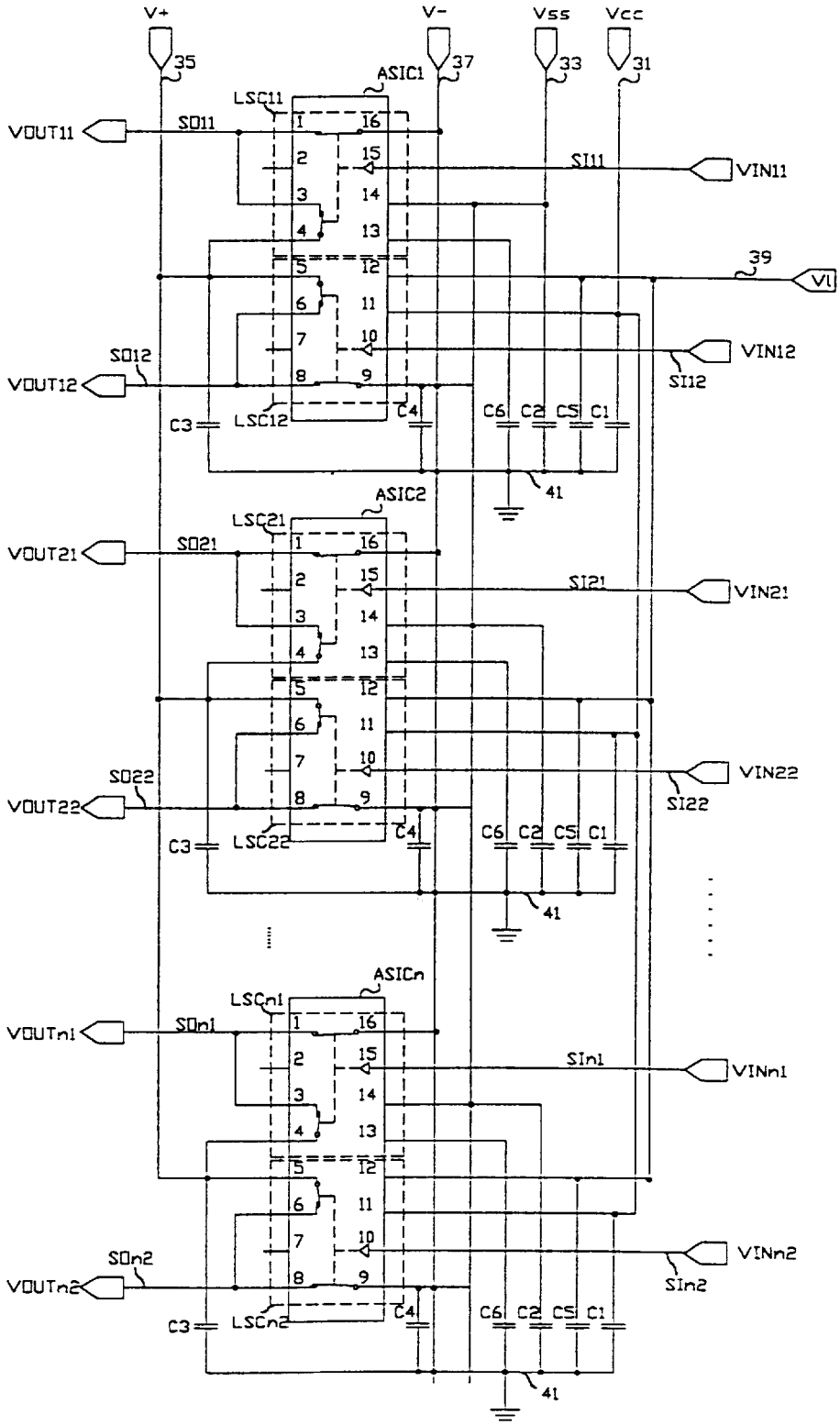
FIG. 5 is a schematic diagram showing a configuration of a liquid crystal display apparatus with a level shifting function according to preferred embodiment of the present invention.

Referring to FIG. 5, there is shown a level shifting apparatus according to a preferred embodiment of the present invention. The level shifting apparatus includes n switch integrated circuits (IC) ASIC1 to ASICn for commonly receiving first high level and low level voltage signals Vcc and Vss on first and second voltage input lines 31 and 33, second high level and low level voltage signals V+ and V− on third and fourth voltage input lines 35 and 37, and a transistor-transistor logic (TTL) voltage signal V1 on a fifth voltage input lines 39. The first high level signal Vcc on the first voltage input line 31 is applied to a terminal number 11 of n switch ICs ASIC1 to ASICn, and the second low level signal Vss on the second voltage input line 33 is applied to terminal number 14 of n switch ICs ASIC1 to ASCIn.

These first high and low voltage signals Vcc and Vss is used to drive high level circuit devices included in the n switch ICs ASIC1 to ASCIn. The second high level voltage signal V+ on the third voltage input line 35 is applied to terminal numbers 4 and 5 of the n switch ICs ASIC1 to ASICn, and the second low level voltage signal V− on the fourth voltage input line 37 is applied to terminal numbers 9 and 16. The high and low level voltage signals V+ and V− are used to shift voltage levels of signals. Finally, the TTL voltage signal V1 is applied to terminal number 12 of the n switch ICs ASIC1 to ASCIn and is used to drive logic circuit devices included in the n switch ICs ASIC1 to ASICn.

The first high and low level voltage signal Vcc and Vss, the second high and low level voltage signal V+ and V− and the TTL voltage signal V1 is generated at a power supply included in the PDL 14 or externally provided. The first high and low level voltage signals Vcc and Vss are +20 V and −20 V; the second high and low voltage signals V+ and V− are +15 V and −15 V; and the TTL voltage signal V1 is +5 V. The terminal number 13 for each of switch ICs ASIC1 to ASICn are connected via a ground line 41 to the ground GND.

Figure 6:
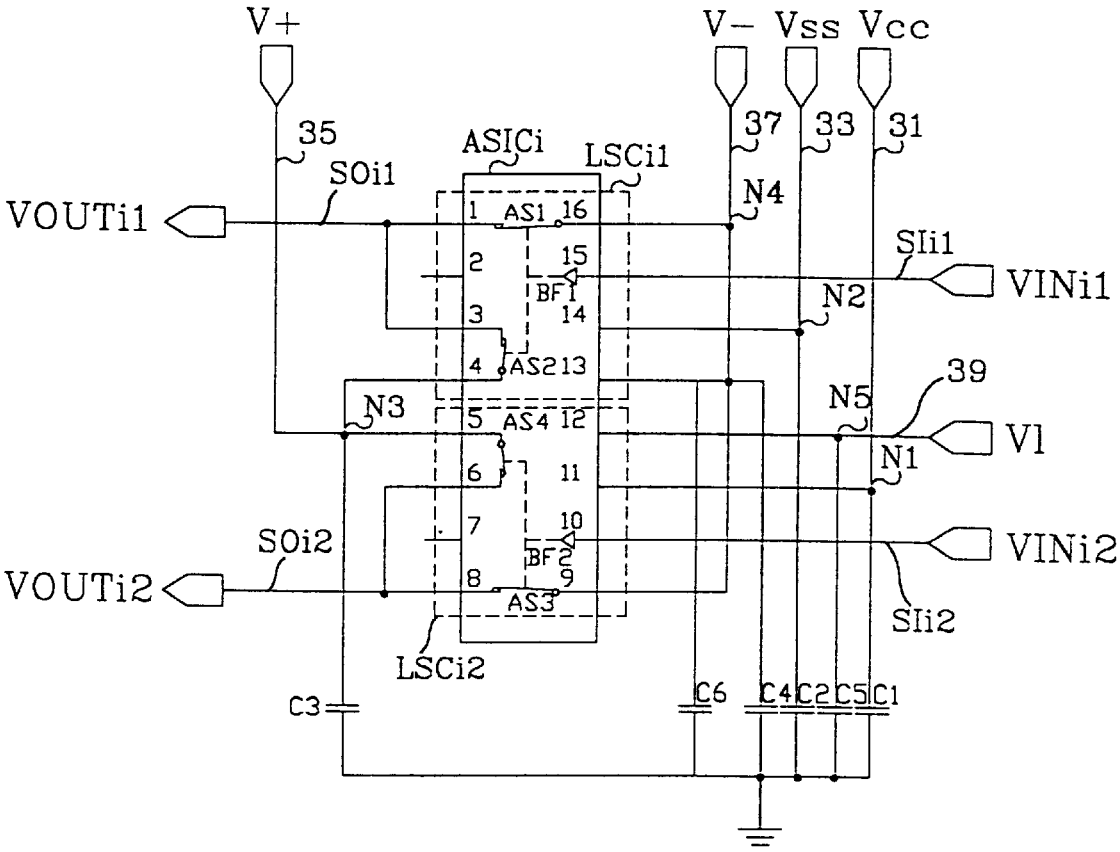
FIG. 6 is a detailed diagram of one of the switch integrated circuits shown in FIG. 5.

Further, first to sixth capacitors C1 to C6 are connected to each switch IC ASIC1 to ASICn, as further illustrated in FIG. 6. These first and sixth capacitors C1 to C6 bypass noise signals of high frequency component contained in the voltage signals Vcc, Vss, V+, V−, V1 and GND in such a manner that the noise signals of high frequency component is not coupled to the IC switches. The first capacitor C1 is connected between a connection node N1 of a terminal number 11 of the switch IC ASIC with the first voltage input line 31 and the ground line 41. The second capacitor C2 is connected to a connection node N2 of a terminal number 14 of the switch IC ASIC with the ground line 41. The third capacitor C3 is connected between a connection node N3 of terminal numbers 4 and 5 of the switch IC ASIC with the ground line 41. The fourth capacitor C4 is connected between a connection node N4 of terminal numbers 9 and 16 of the switch IC ASIC with the fourth voltage input line 37 and the ground line 41. The fifth capacitor C5 is connected between a connection node N5 of a terminal number 12 of the switch IC ASIC with the fifth voltage input line 39 and the ground line 41. The sixth capacitor C6 is connected between a terminal number 13 of the switch IC ASIC and the ground line 41.

The respective switch ICs ASIC1 to ASICn includes odd-numbered shifting cells LSC11 to LSCn1 connected between odd-numbered signal input lines SI11 to SIn1 receiving signals VIN11 to VINn1 and odd-numbered signal output lines SO11 to SOn1 outputing signals VOUT11 to VOUTn1, and even-numbered shifting cells LSC12 to LSCn2 connected between even-numbered signal input lines SI12 to SIn2 receiving signals VIN12 to VINn2 and even-numbered signal output line SO12 to SOn2 outputing signals VOUT12 to VOUTn2. The odd-numbered signal input lines SI11 to SIn1 and the even-numbered signal input lines SI12 to SIn2 receives timing control signals or data signals in a shape of pulse VIN11 to VINn1 and VIN12 to VINn2, hereinafter referred to as "pulse signal", from the PLD 14 of FIG. 2. These pulse signals have usually a TTL voltage level of 3.3 V to 5 V.

Figure 1:
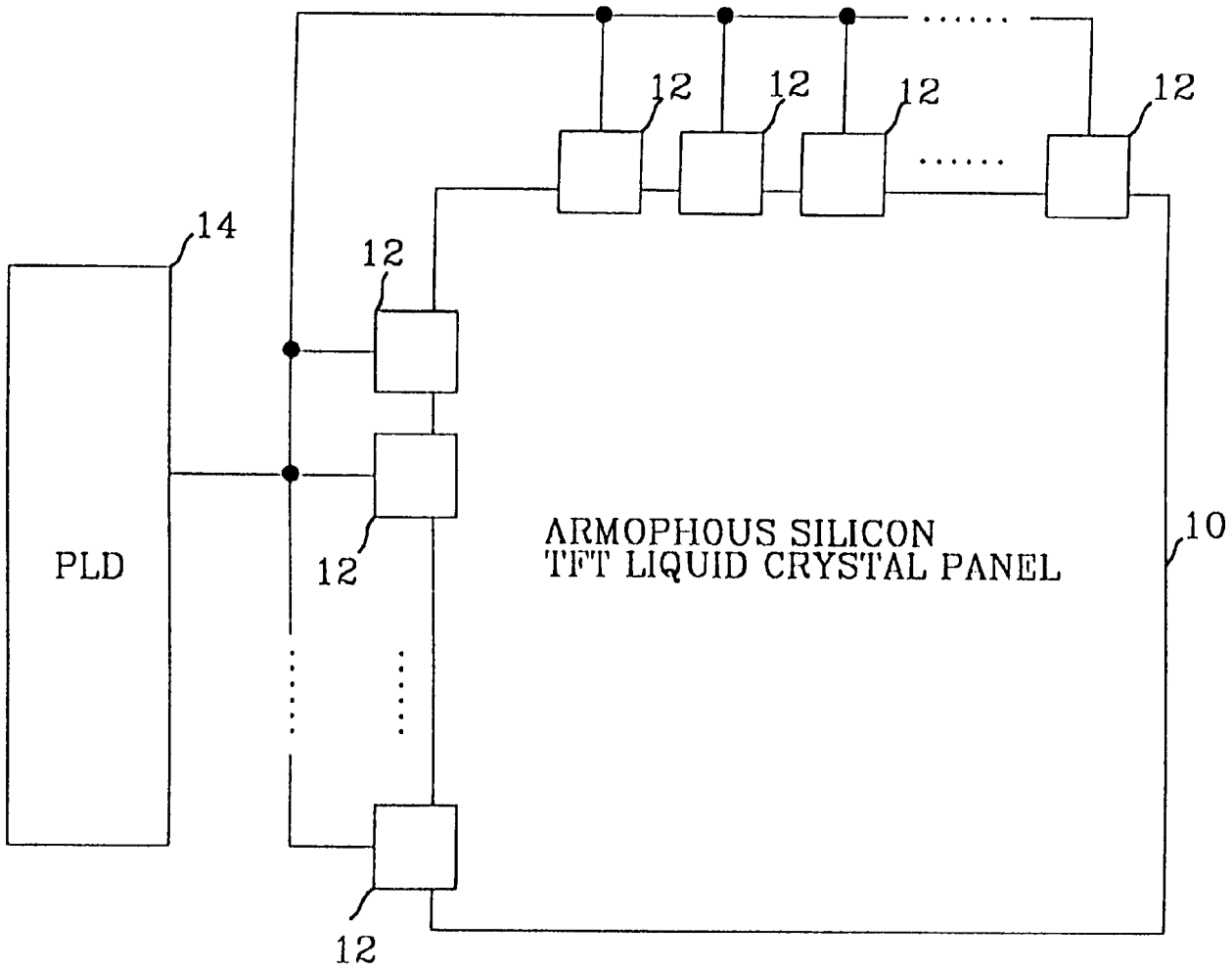
FIG. 1 PRIOR ART
FIG. 1 is a schematic diagram showing a configuration of a liquid crystal display apparatus employing amorphous silicon TFTs.
Figure 2:
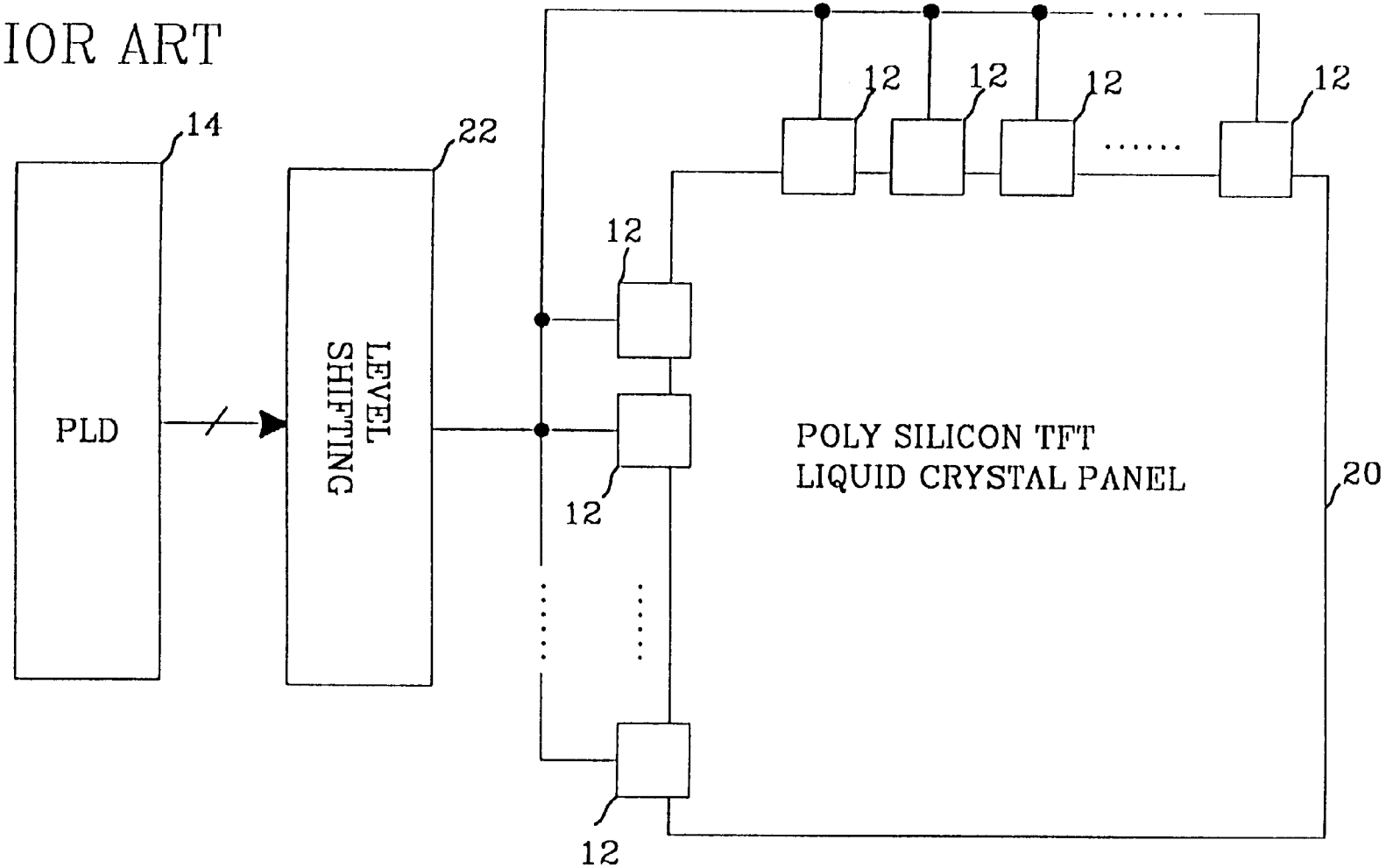
FIG. 2 PRIOR ART
FIG. 2 is a schematic diagram showing a configuration of a liquid crystal display apparatus employing poly silicon TFTs.

On the other hand, the odd-numbered output lines SO11 to SOn1 and the even-numbered output lines SO12 to SOn2 transfer level-shifted pulse signals VOUT11 to VOUTn1 and VOUT12 to VOUTn2 to the D-ICs 12 shown in FIG. 2.

Each of the odd-numbered and even-numbered shift cells LSC selectively outputs the second high level signal V+ and the second low level signal V− in response to voltage levels of the pulse signals VIN11 to VINn1 and VIN12 to VINn2 having a swing width of 3.3 V to 5 V, thereby generating pulse signals VOUT11 to VOUTn1 and VOUT12 to VOUTn2 having a swing width of 30 V which is a voltage difference between the second low level voltage signal V− from the second high level voltage signal V+. The pulse signals VOUT11 to VOUTn1 and VOUT12 to VOUTn2 level-shifted in this manner are applied to the D-ICs 12 in FIG. 2 and allow a picture to be displayed on the poly-silicon liquid crystal panel 20.

As shown in FIG. 6, each of the odd-numbered and even numbered shifting cells LSCi1 and LSCi2 included in a single switch IC ASIC comprises two analog switches and one buffer. More specifically, each of the odd-numbered shifting cells LSCi1 includes a first analog switch AS1 connected between terminal numbers 1 and 16 of the switch IC ASIC, a second analog switch AS2 connected between terminal numbers 3 and 4 of the switch IC ASIC, and a first buffer BF1 for buffering the applied pulse signal VINi1, via a terminal number 15 of the switch IC ASIC, from the odd-numbered signal input line SIi1.

The first switch AS1 is turned on when a pulse signal applied from the first buffer BF1 remains at a logical value "0", i.e., 0 V, to deliver the second low level voltage signal V− applied via the fourth voltage input line 37 and the terminal number 16, to the terminal number 1 connected to the odd-numbered signal output line SOi1. Meanwhile, the second switch AS2 is turned on when a pulse signal applied from the first buffer BF1 remains at a logical value "1", i.e., 3.3 to 5 V, to deliver the second high level voltage signal V+ applied via the third voltage input line 35 and the terminal number 4, to the terminal number 1 connected to the odd-numbered signal output lines SOi1. As a result, the level-shifted pulse signals VOUTi1 allowing the second low level voltage V− and the second high level voltage V+ to be logical values of "0" and "1", respectively, are generated at the odd-numbered signal output lines SOi1.

Similar to the odd-numbered shifting cells LSCi1, the even-numbered shifting cells LSCi2 includes a third analog switch AS3 connected between terminal numbers 8 and 9 of the switch IC ASIC, a fourth analog switch AS4 connected between terminal numbers 5 and 6 of the switch IC ASIC, and a second buffer BF2 for buffering pulse signals VINi2 applied, via a terminal number 10 of the switch IC ASIC, from the even-numbered signal input lines SIi2. The third switch AS3 is turned on when a pulse signal applied from the second buffer BF2 remains at a logical value "0", i.e., 0 V, to deliver the second low level voltage signal V− applied via the fourth voltage input line 37 and the terminal number 9, to the terminal number 8 to the even-numbered signal output lines SOi2. Meanwhile, the fourth switch AS4 is turned on when a pulse signal applied from the second buffer BF2 remains at a logical value "1", i.e., 3.3 to 5 V, to deliver the second high level voltage signal V+ applied via the third voltage input line 35 and the terminal number 5, to the terminal number 6 to the even-numbered signal output lines SOi2. As a result, the level-shifted pulse signals VOUTi2 allowing the second low level voltage V− and the second high level voltage V+ to be logical values of "0" and "1", respectively, are generated at the even-numbered signal output lines SOi2. Since first to sixth capacitors C1 to C6 have the same function and operation as those in FIG. 5, an explanation as to them will be omitted.

Figure 7:
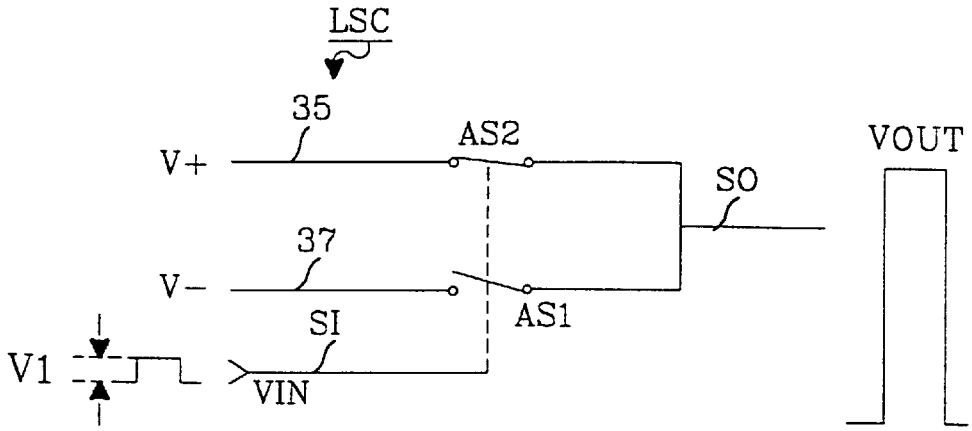
FIG. 7 is an electrical equivalent circuit diagram of the shift cells shown in FIG. 5 and FIG. 6.

FIG. 7 illustrates an electrical equivalent circuit of the odd-numbered shifting cell LSC of FIG. 5 and FIG. 6. The shifting cell LSC includes a first analog switch AS1 connected between the fourth voltage input line 37 and the signal output line SO, and a second analog switch AS2 connected between the third voltage input line 35 and the signal output line SO. These analog switches AS1 and AS2 provides a complementary switching operation in response to a pulse signal VIN on the odd-numbered input line SI having a swing width of 3.4 V to 5 V.

In other words, the first analog switch AS1 is turned on during an interval when the pulse signal VIN maintains "0 V" to deliver the second low level voltage signal V− onto the signal output line SO; while the second analog switch AS2 is turned on during an interval when the pulse signal VIN maintains "3.3 to 5 V" to deliver the second high level voltage signal V+ onto the signal output line SO. By the complementary switching operation of the two analog switches AS1 and AS2, a pulse signal having a swing width corresponding to a difference voltage, i.e., 30 V, between the second high level and low level voltage signals V+ and V− is generated at the odd-numbered signal output line VOUT.

Figure 3:
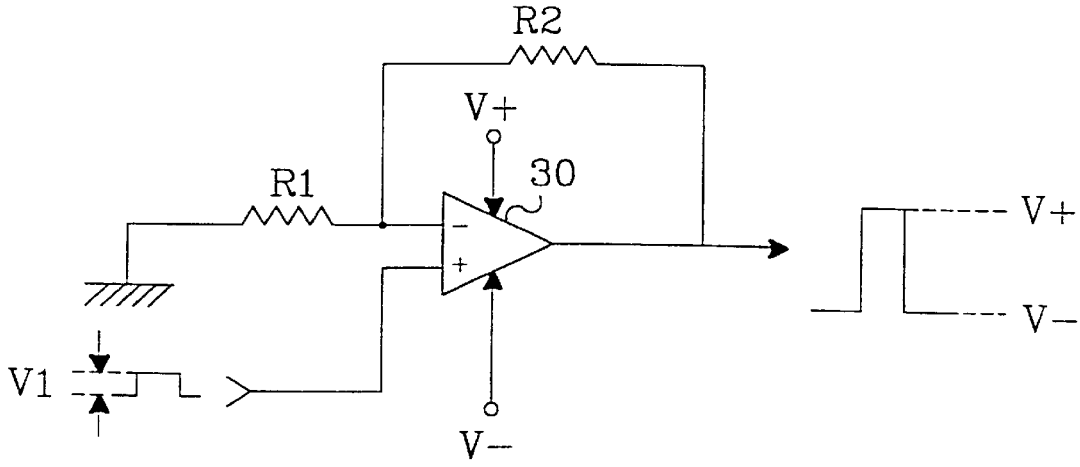
FIG. 3 PRIOR ART
FIG. 3 is a detailed circuit diagram of an amplifier used for a level shifter.
Figure 4:
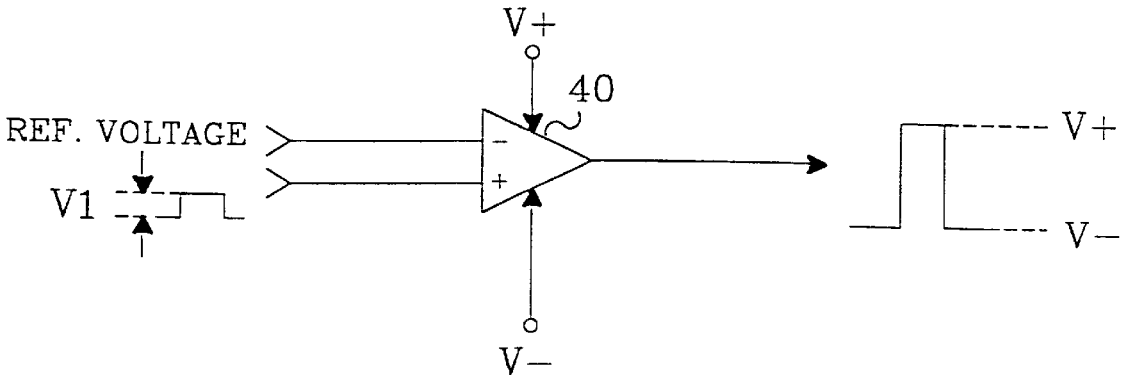
FIG. 4 PRIOR ART
FIG. 4 is a detailed circuit diagram of a comparator used for a level shifter.

The level shifting apparatus configured in the above manner can more rapidly shift the voltage levels of pulse signals and reduce the power consumption in comparison to the level shifting apparatus including amplifiers and comparators of FIGS. 3 and 4. Accordingly, the liquid crystal display apparatus according to a preferred embodiment of the present invention is capable of minimizing the signal delay as well as reducing the power consumption. Further, in a liquid crystal display apparatus according to a preferred embodiment of the present invention, the simplification thereof is easily obtained through the simplified circuit configuration of the level shifting apparatus.

The foregoing embodiments are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-functind clauses are intended to cover the structures described herein as performing the recited function and not only structural equivalents but also equivalent structures.

What is claimed is:

1. An integrated switching device for a display panel responsive to at least one of control and data signals, comprising:

a first cell having a first switch and a second switch which are responsive to at least one of control and data signals, said first switch being coupled for receiving a first voltage at a first input line and providing a first output at a first output line, and said second switch being coupled for receiving a second voltage at a second input line and providing a second output at the first output line; and a second cell having a third switch and a fourth switch which are responsive to at least one of control and data signals, said third switch being coupled for receiving the first voltage at the first input line and providing a third output at a second output line, and said fourth switch being coupled for receiving the second voltage at the second input line and providing a fourth output at a second output line, wherein each of said first, second, third, and fourth switches output one of the first and second voltages as the first, second, third and fourth outputs, respectively, in response to at least one of control signals and data signals, a voltage difference between the first and second voltages being greater than a voltage difference of a corresponding control signal or a corresponding data signal.

2. The integrated switching device of claim 1, wherein said first and second switches operate in complement in response to at least one of control and data signals.

3. The integrated switching device of claim 2, further comprising a buffer coupled for receiving at least one of control and data signals and coupled to said first and second switches to control the complement operation.

4. The integrated switching device of claim 1, wherein said third and fourth switches operate in complement in response to at least one of control and data signals.

5. The integrated switching device of claim 4, further comprising a buffer coupled for receiving at least one of control and data signals and coupled to said third and fourth switches to control the complement operation.

6. The integrated switching device of claim 1, further comprising a first filtering device coupled to said first and third switches at the first input line and a second filtering device coupled to said second filtering device coupled to said second and fourth switches at the second input line.

7. The integrated switching device of claim 6, wherein said first and second filtering devices are capacitors.

8. The integrated switching device of claim 1, wherein said first, second, third and fourth switches are analog switches.

* * * * *